US005269102A

United States Patent [19]

Wood

[11] Patent Number: 5,269,102

[45] Date of Patent: Dec. 14, 1993

[54] DISPOSABLE LAP BLANK

[75] Inventor: Kenneth O. Wood, Stafford, Conn.

[73] Assignee: Gerber Optical, Inc., South Windsor, Conn.

[21] Appl. No.: 717,685

[22] Filed: Jun. 19, 1991

[51] Int. Cl.[5] ..... B24B 7/24

[52] U.S. Cl. ..... 51/209 DL; 279/111; 279/126; 269/900

[58] Field of Search ..... 51/209 R, 209 DL, 216 R, 51/216 LP, 216 T, 236, 237; 269/900; 279/111, 126

[56] References Cited

U.S. PATENT DOCUMENTS

| | | | |
|---|---|---|---|
| 2,352,616 | 7/1944 | Canning . | |
| 2,441,472 | 5/1948 | D'Avaucourt . | |
| 3,417,454 | 12/1968 | Beasley . | |
| 3,491,489 | 1/1970 | Rudd . | |
| 3,501,842 | 3/1970 | Beasley . | |
| 3,512,310 | 11/1966 | Rudd et al. . | |
| 3,522,677 | 5/1967 | McCall et al. . | |
| 3,665,651 | 5/1972 | Wylde . | |
| 3,685,214 | 8/1972 | Sarofeen | 51/209 DL |
| 3,704,558 | 12/1972 | Sarofeen . | |
| 3,815,294 | 6/1974 | Martiros . | |
| 4,019,285 | 4/1977 | Gravell . | |
| 4,267,672 | 5/1981 | Sorrells . | |
| 4,274,232 | 6/1981 | Wylde . | |
| 4,341,045 | 7/1982 | Sorrells . | |
| 4,447,180 | 5/1984 | Pesch | 279/111 |
| 4,459,784 | 7/1984 | Hernandez et al. . | |
| 4,536,000 | 8/1985 | Rohm | 279/126 |
| 4,540,318 | 9/1985 | Hornung et al. | 279/126 |
| 4,645,220 | 2/1987 | Hiestand | 279/111 |
| 4,789,424 | 12/1988 | Fornadel | 51/216 T |
| 4,962,618 | 10/1990 | Wylde . | |
| 5,076,023 | 12/1991 | Saguchi | 51/204 |

FOREIGN PATENT DOCUMENTS

| | | |
|---|---|---|
| 0371621 | 6/1990 | European Pat. Off. . |
| 2039810 | 8/1980 | United Kingdom . |
| 2073065 | 10/1981 | United Kingdom . |
| 2185917 | 8/1987 | United Kingdom . |
| 2196886 | 5/1988 | United Kingdom . |
| 2230487 | 10/1990 | United Kingdom . |

*Primary Examiner*—Jack Lavinder

*Attorney, Agent, or Firm*—McCormick, Paulding & Huber

[57] ABSTRACT

A lap blank and holder assembly includes a lap blank having two spaced apart flat surfaces separated by a given thickness and formed from a material capable of compressing about a member inserted into it. The holder has a projection extending outwardly from a front face thereof and is inserted into the material making up the lap to secure it against rotational and shifting movement while being cut in a surfacing machine. This arrangement further allows the assembly to be placed as an assembly in a finishing machine for subsequent polishing of a cut lens surface in a polishing procedure.

9 Claims, 3 Drawing Sheets

DISPOSABLE LAP BLANK

CROSS REFERENCE TO RELATED APPLICATION

The present application relates to co-pending U.S. patent application Ser. No. 07/604,052, filed on Oct. 26, 1990, in the name of Kenneth O. Wood, on SINGLE BLOCK MOUNTING SYSTEM FOR SURFACING AND EDGING OF A LENS BLANK AND METHOD THEREFOR now U.S. Pat. No. 5,210,695 issued on May 11, 1993, which application being commonly assigned with the assignee of the present invention and being hereby incorporated by reference.

BACKGROUND OF THE INVENTION

This invention relates to a disposable lap blank capable of being custom cut to fit the prescribed contour of a lens blank thus allowing where necessary for off-axis polishing of the lens blank through the intermediary of the custom fit lap wherein the improvement in such lap includes a means provided in the disposable lap for receiving a holder capable of mounting it for cutting to a surfacing machine and subsequently to a finishing or polishing machine for polishing of the lens blank for which it was custom cut.

In U.S. Pat. No. 4,989,316 entitled METHOD AND APPARATUS FOR MAKING PRESCRIPTION EYEGLASS LENSES, issued to Logan, et al. on Feb. 5, 1991, commonly assigned herewith, and in the aforesaid copending U.S. patent application Ser. No. 07/604,052, entitled SINGLE BLOCK MOUNTING SYSTEM FOR SURFACING AND EDGING OF A LENS BLANK AND METHOD THEREFOR, a disposable lap blank is disclosed wherein the lap is adapted to be held in driving rotation in a surfacing machine which shapes it by cutting in order create thereon an inverse profile of the surface cut into the lens. Additionally, it is therein disclosed to utilize the same lap and associated holding means to secure the custom cut lap blank on a finishing machine wherein the cut lens surface undergoes polishing. Hitherto the holding means used to generically mount the lap blank in its initial uncut state to the surfacing machine and subsequently after cutting to a polishing machine, was carried by the blank as an integral part thereof. This involved the use of a steel backing plate which during the manufacturing process of the stock laps first had to be mounted to the rear face of the lap blank on a raised portion thereof to allow gripping of it by the respective surfacing and finishing machines. Fabricating the stock lap blank piece with the metal plate was very labor intensive. First, it required the worker to carefully align the raised portion of the lap blank with the plate. An adhesive applied to the plate caused it to be bonded with the lap at the angle it dried at regardless of whether it was perfectly aligned with the underlying portion. Any such misalignment would adversely affect the outcome of the lens being made in that the plate and the underlying raised portion might be gripped at different angular orientations by the different means used for holding the blank in each of the surfacing and finishing machines. This is especially critical in the situation where laps having a very high cylinder component to them are so misaligned with the backing plate such that even the slightest twist or axis shift can be critical to the polishing result sought to be achieved. Additionally, in these previously known lap blanks it was required during the manufacturing process to affix a small magnetic piece at a designated location on the lap for the purpose of indicating to the surfacing machine that it was presently cutting a lap blank rather than a lens blank and that the inverse of the lens configuration was to be cut instead into the lap blank thereby customizing it to fit the lens configuration. Such individual fitting of magnetic pieces to each of the laps added still another labor intensive step involved in their manufacture. This practice was further made cost ineffective by the magnetic strip having to be thrown away with the disposable blank after use.

Accordingly, it is an object of the present invention to provide a disposable lap blank wherein the improvement comprises a separate holder having a means which releasably, yet securably engages the lap blank to hold it in such orientation while the lap surface is either being cut in a surfacing machine or while the lap is being used to polish the cut lens surface. In keeping with the foregoing object, a more specific object of the invention is to provide in a lens making system, a lap blank and associated holder assembly wherein the holder is adapted to be received and held generically in driving engagement within the lens surfacing machine and within the polishing machine thus avoiding the hitherto problems associated with fabricating the mounting parts on the disposable lap.

A still further object of the present invention is to provide a disposable lap and a reusable holder assembly of the aforementioned type wherein the holder is readily secured to the disposable lap blank in a given orientation through the intermediary of coengaged pieces adapted to releasably yet securably hold the two members to one another.

Yet still a further object of the present invention is to provide a lap blank holder of the aforementioned type wherein the holder is configured such that it is readily held in a given orientation by the user allowing it to be inserted into the lap blank without significant aligning checks being made.

Further objects and advantages of the present invention will become apparent from the following Disclosure and the appended claims.

SUMMARY OF THE INVENTION

The invention resides in a lap blank and holder for use as an assembly in a lens making process wherein the assembly comprises a lap having a first side face and an opposite second side face separated from one another by a given thickness and a holder having at least one face directed towards one of the first and second side faces of the lap, the at least one face of said holder including means extending therefrom for engaging with the lap inwardly and beyond one of the first and second lap faces and wherein the lap is formed from a material capable of gripping the holder engagement means.

The invention further resides in a method of forming a lap blank and holder assembly comprising providing a lap blank having two opposite side surfaces disposed thereon separated from one another by the thickness of the material which comprises it; providing a holder having at least one surface thereon and disposing on the at least one surface thereof an engagement member extending outwardly a given distance therefrom; forming the lap from a material capable of being compressed locally around a member inserted into it; selecting the given distance at which the engagement member extends such that the engagement member is caused to be releasably held within the lap against axial movement therein and for rotation therewith; and securing the lap to the holder through the intermediary of the engagement member by inserting it into the lap through one of the two opposed side surfaces causing the material surrounding the engagement member to compress around and to hold the inserted engagement member to be held against axial movement and for rotation therewith.

DETAILED DESCRIPTION OF THE PREFERRED EMBODIMENT

Figure 1:
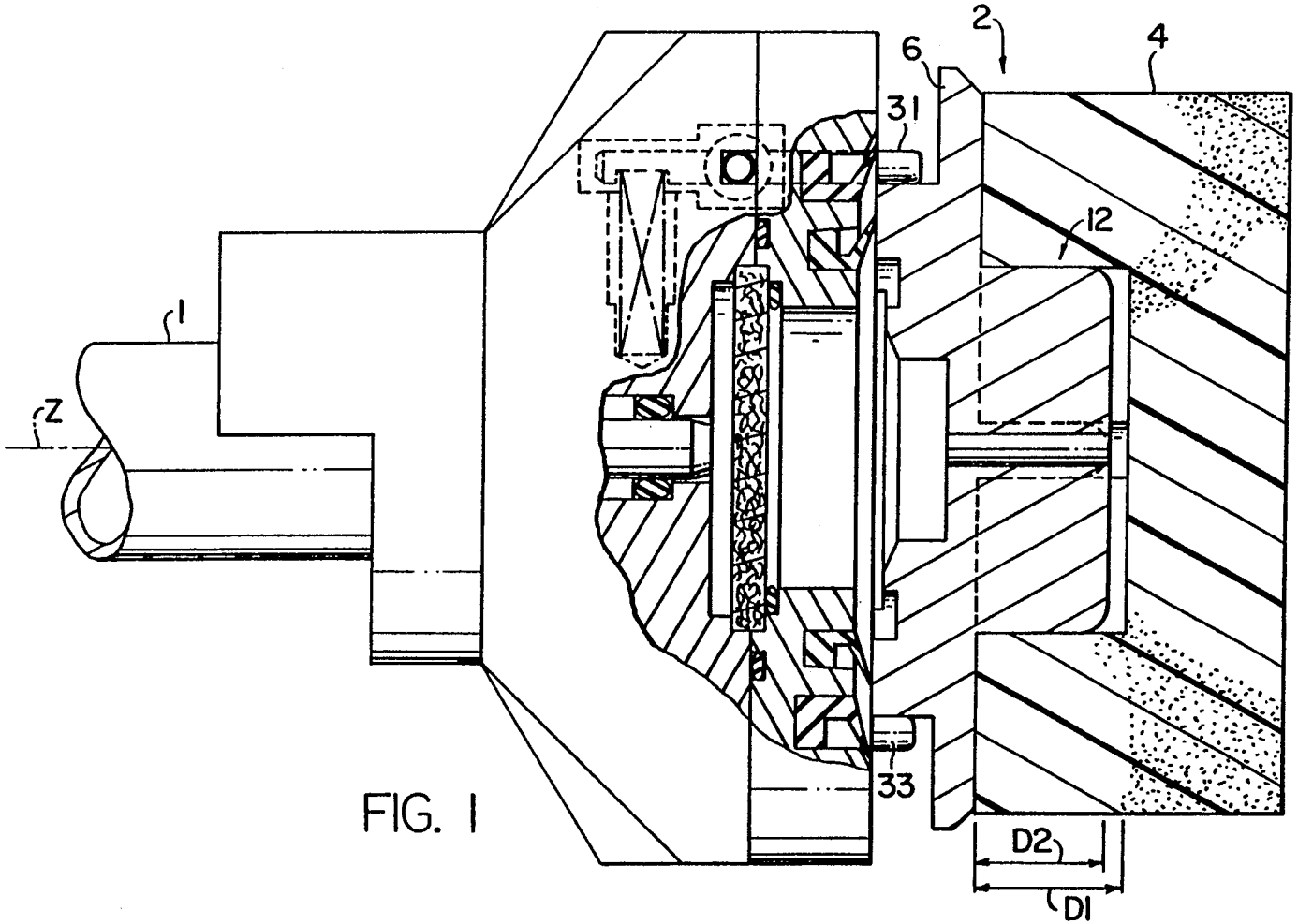
FIG. 1 is a partially fragmentary side elevation view showing the disposable lap blank and holder mounted to the chuck of a surfacing machine.
Figure 3:
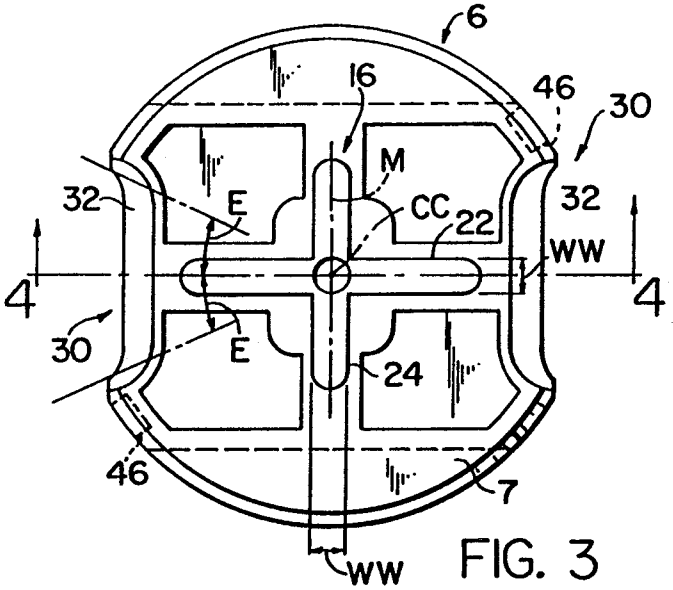
FIG. 3 is a top plan view showing the engagement member of the lap holder.
Figure 4:
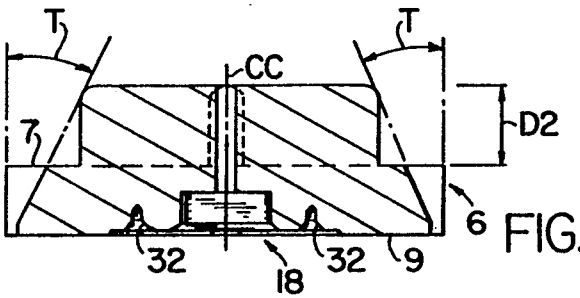
FIG. 4 is a sectional view taken through the holder along line 4—4 in FIG. 3.

In FIG. 1 a lap blank and holder assembly illustrated generally as 2 is shown. The assembly 2 includes a disposable lap 4 and an associated holder 6 each of which being provided with in accordance with the invention a means 12 for releasably securing one member of the assembly to the other. As shown therein, the lap blank assembly 2 is held by a chuck 3 on a surfacing machine 1 for rotation about a Z axis for cutting a desired surface into a lens blank as well as for cutting an inverse of that surface into the lap blank 4. The machine 1 may be one such as disclosed in aforementioned U.S. Pat. No. 4,989,316, entitled METHOD AND APPARATUS FOR MAKING PRESCRIPTION EYEGLASS LENSES and in copending U.S. patent application entitled SINGLE BLOCK MOUNTING SYSTEM FOR SURFACING AND EDGING OF A LENS BLANK AND METHOD THEREFOR. As disclosed therein, the chuck 3 is capable of mounting to it through an applied vacuum either a lens or a lap blank for computer controlled cutting of a surface thereon such that the lap blank custom fits the contour of the cut lens blank inner exposed surface thus providing the capability for off-axis polishing of the lens surface. As will become apparent later with reference to FIG. 6, the lens blank and holder assembly 2 is further adaptable to be used within a finishing machine for the purpose of polishing the cut lens surface associated with it.

Figure 2:
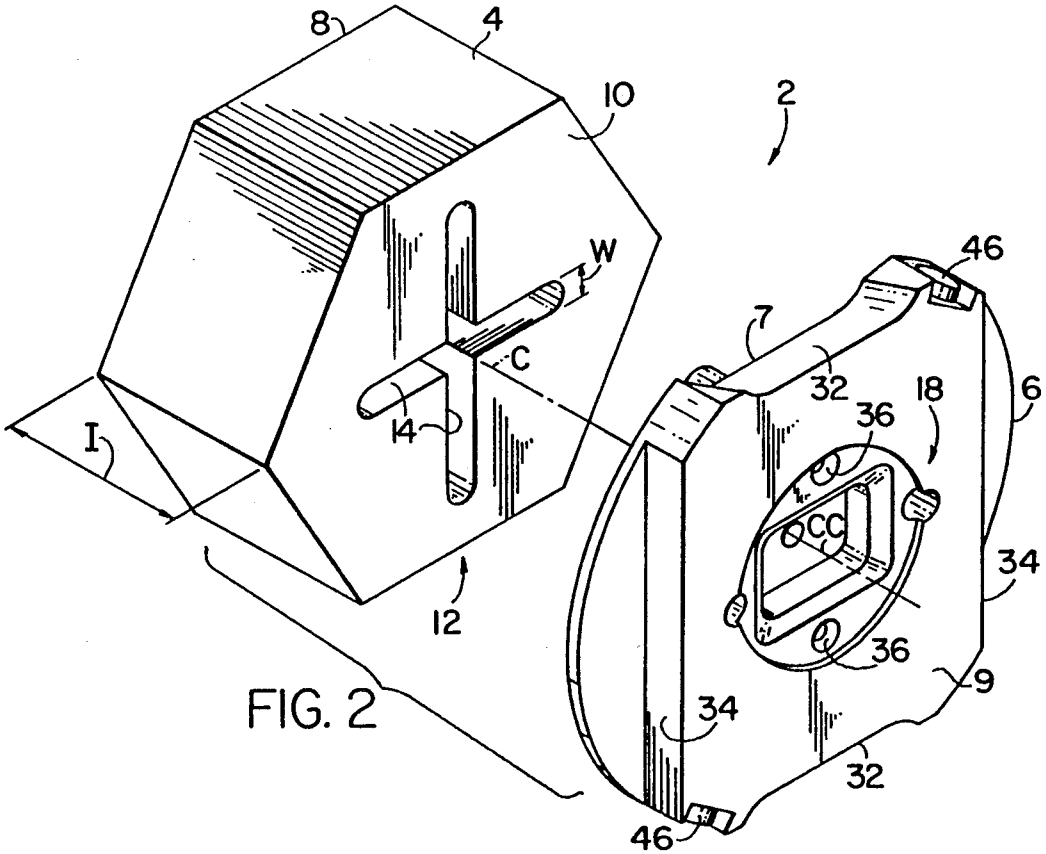
FIG. 2 is a perspective view of the lap blank and the holder assembly shown separated from one another.

Referring to FIG. 2, the illustrated disposable lap 4 is comprised of a block of material which is readily cutable by the rotating cutting tool associated with the surfacing machine, yet is considerably strong in compression and to other forces acting on it to support a lens blank and block assembly during polishing of the lens. One example of a material suitable for this purpose is foamed polystyrene, commercially available in extruded form. In the illustrated embodiment, the lap blank 4 has a first side face 8 and an opposite second side face 10 with each side face being separated from the other by the thickness I of the lap, equaling about 1.25 inches. The lap 4 may take various shapes, but as illustrated it has a six-sided parallelogram configuration with opposite sides thereof measuring across about 3.0 inches.

The holder 6 has a first side face 7 facing the lap blank 4 and an oppositely facing second side face 9 and includes a raised central portion 18 interposed between each of the side faces. The raised central portion 18 of the holder 6 has a generally square-like configuration as defined by two generally parallel flats 34,34 spaced from one another by two interconnecting surfaces 32,32 which taken together with the flats 34,34 define the general body of the holder 6. Formed within the raised central portion 18 is a pin locating means 36 in the form of two spaced blind tapered openings allowing the holder 6 in certain situations to be mounted in registry with engagement pins carried by a finishing machine for oscillating the holder assembly 2 relative to a lens surface in a manner that will hereinafter become apparent with reference to FIG. 6.

The disposable lap 4 and associated holder 6 which together constitute the lap blank assembly 2 are releasably interengaged with one another through the intermediary of a holding means 12. The means 12 includes a receiving means 14 formed in the second side face 10 of the lap 4 and a correspondingly shaped engagement member 16 projecting outwardly from the first face 7 of the lap holder. In the illustrative embodiment, the receiving means 14 is comprised of two slot-like blind recesses extending a depth D1 into the lap 4, to define a cross-shaped configuration therein with the intersection thereof being coincident with the geometric center C of the lap 4 and with the center CC of the holder 6 when it is secured to it. In a like manner, the engagement member 16 formed on the holder 6 is correspondingly shaped and sized to fit within the receiving means 14 and includes for this purpose a first portion 22 disposed along a major axis N and a second portion 24 extending coincidentally with a minor axis M, the major and minor axes N and M intersecting at right angles coincidentally with the geometric center CC of the holder 6. The first and second portions 22 and 24 of the engagement member 16 are integrally formed with the surface 7 of the holder 6 and each extends outwardly therefrom a given depth D2 slightly less than the dimension D1 for projecting into the lap 4 to allow securement therebetween. While not limited to the cross-shaped configuration shown herein, the engagement member 16 may take alternative forms, such as a chevron or a V-shape, so long as the selected configuration positions the involved lap on the holder coincidentally with its geometric center CC.

The lap 4 being formed from a material sufficiently strong in compression, grips the engagement member 16 after it has been inserted into the receiving means 14. To this end, the widths W of the recesses making up the means 14 is somewhat smaller in dimension than that of the corresponding widths WW of the constituent parts of the engagement member 16 so as to effect an interference fit between the lap 4 and the holder 6. For this purpose, the leading ends of the engagement member 16 are chamfered such that with the continued urging of the holder into the recesses formed in the lap blank 4, an interference between the two materials causes the lap material to be compressed in this localized region, thus securing the two members against axial, shifting and rotational movement. The relative difference between dimensions W and WW is in a typical example about 1/100th of an inch, with the holder 6 being formed from a relatively hard material which lends itself to being driven into the lap material receiving it, an example of which holder material suitable for this purpose is a 6/10 nylon with 30% glass fill.

To effect automatic registration of the receiving means recesses 14 with the engagement member 16, the holder 6 further includes a means 30,30 for permitting an operator to grip the holder 6 and consistently orient it with respect to the major and minor axes of the engagement member 16 such that when it is so gripped, the orientation of the member 16 will be automatically known by the user to be with the major axis N being disposed horizontally and the minor axis disposed vertically. For this purpose, the surfaces 32,32 interconnecting the flats 34,34 to one another each tapers outwardly from the first side face 7 and continuing to the second side face 9 of the holder 4 at the indicated angle T. In addition to tapering between the first and second side faces 7 and 9, the connecting surfaces 32,32 are radially inwardly directed towards the holder center CC at angles E,E allowing the user to better pinch the holder as it is gripped by the thumb and the index and second fingers.

Figure 5:
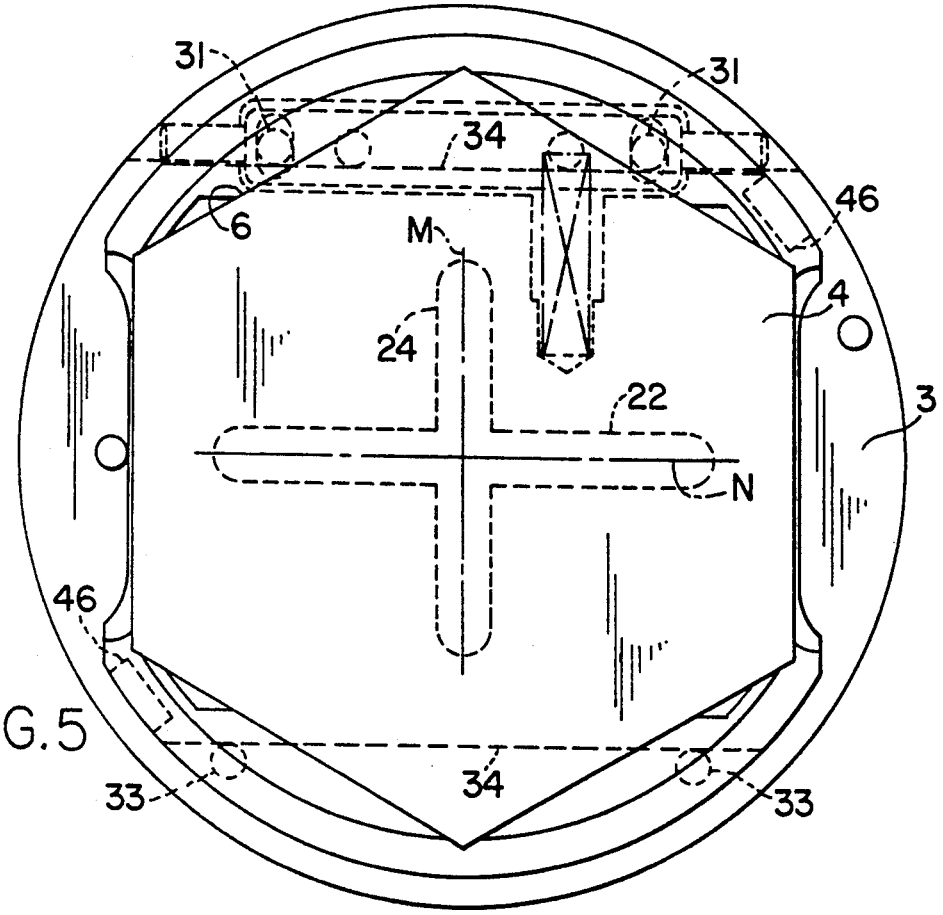
FIG. 5 is a front elevation view looking at the chuck of FIG. 4 from the right side.

The construction of the holder engagement member 16 may be selected such that the lap blank 4 when secured to the holder 6 is oriented in such a manner that it can be disposed in either of one of two angular orientations 180 degrees set apart from each other without causing error in the lens surface fabricating process. That is, as seen in FIG. 5, the major axis N being disposed parallel to the flats 34,34 insures that the lap, if it is separated from the holder after a surfacing operation is performed on it, can be resecured to either the same holder or, for example, one made permanently part of a polishing machine, without causing the cylinder axis to be oriented other than along the line in which it was originally cut taken relative to the holder. The generally square configuration of the raised central portion 18 of the holder is particularly well adapted to be held in place on the chuck 3 along each of the flats 34,34 by the chuck locating pin pairs 31 and 33, the moveable ones of which 31,31 urging the lap holder 6 in securement against the stationary of which pairs 33,33.

In the aforementioned U.S. Pat. No. 4,989,316 and in the copending application entitled SINGLE BLOCK MOUNTING SYSTEM FOR SURFACING AND EDGING OF A LENS BLANK AND METHOD THEREFOR, it is disclosed that the surfacing machine 1 is capable of mounting either a lap or a lens blank for rotation about the indicated Z axis to effect cutting of a desired surface thereon. To indicate the type of blank being used, a sensor is provided adjacent the chuck 3 in the surfacing machine 1 and signals to the controller the type of blank being mounted in the machine. Coacting with the sensor are two diametrically opposed indicators, preferably magnetic, provided in the holder 6 on off-set portions of the raised central portion 18 adjacent each of the flats 34,34. The indicators 46,46 being diametrically opposed insure that one of them is located adjacent the sensor when the lap blank and holder assembly 2 is mounted to the chuck 10.

Figure 6:
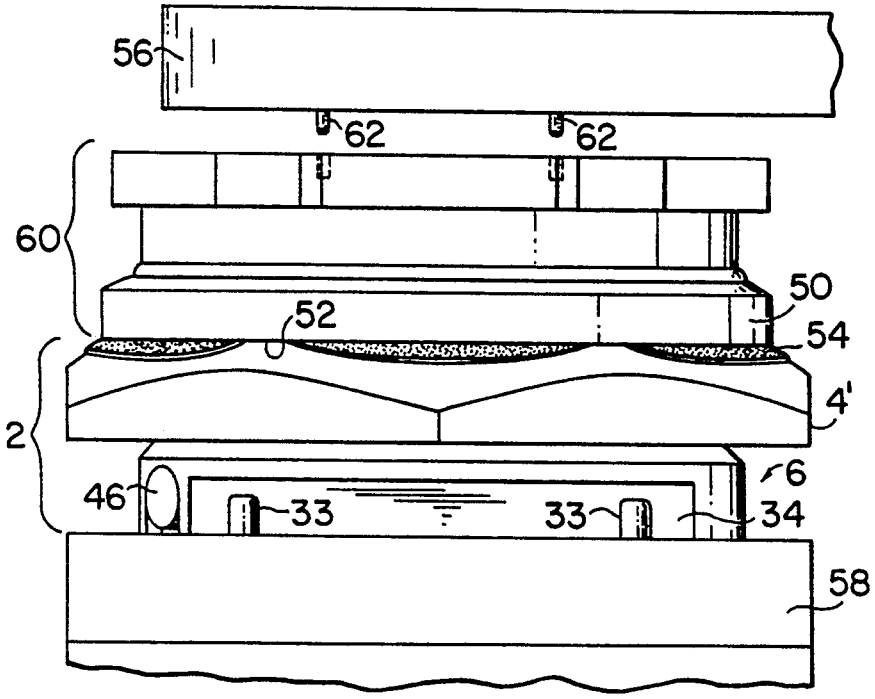
FIG. 6 is a side elevation view showing the disposable lap and holder as mounted in a polishing machine for work on a cut lens blank.

In FIG. 6, the lap blank and holder assembly 2 is shown mounted in a polishing and finishing machine for the purpose of creating a smooth surface on the lens 50 that has been cut by the surfacing machine 1. Here the lap 4' is shown after having a surface inversely mirroring that found on the lens 50 cut into it. Applied to the cut lap 4' through the intermediary of an adhesive is an abrasive pad 54 having a desired textured surface for creating a sufficiently smooth surface 52 on the cut face of the lens 50. This finishing step is accomplished in a conventional manner by stacking the lens blank and block assembly 60 with the lap blank and holder assembly 2 in a conventional finishing machine wherein the two assemblies are clamped with one another between the upper and the lower arms 56,58 of the machine. The lap blank holder 4 is usually clamped to the lower arm 58 along the flats 34,34 while the lens blank assembly 60 is secured to the upper arm 56 for oscillating movement relative to one another for a given period of time to effect finishing of the lens surface 52. It should be understood that in the arrangement shown in FIG. 6, the lens 50 has a conventional surface configuration in that it is of a concave configuration with the inverse of that surface being formed as a convex surface on the cut lap blank 4'. However, in the uncommon yet possible case where the lens surface 52 is convex and that of the lap 4' is concave, the lap blank holder 6 is further adaptable to be held in driving engagement with the upper drive arm 56 of the finishing machine within the locating openings 36,36 formed in the second side face 9 sized and shaped to receive the drive pins 62,62 of the arm 56. In this situation, the best results in the finishing process are achieved by orienting the cut lap with its abrasive pad on the top of the stacked arrangement of FIG. 6, leaving the lens blank and block assembly 60 to be clamped by the lower arm mechanism 58.

In summary, the lap blank assembly 2 is comprised of the lap 4 made from a readily cutable material, such as foam plastic and is secured against rotation, axial and shifting movements while carried by the holder 6 through the intermediary of the engagement member 16. In the preferred embodiment of the invention, the engagement member 16 and the correspondingly sized and shaped receiving means 14 are so constructed as to enable the orientation of the lap with respect to its holder to be disposed in either of two angular orientations set apart by 180 degrees. This allows the cut lap to be separated from its holder and thereafter placed back onto it or onto another holder associated with a new machine, such as the finishing machine, without causing misalignment between the surfaces formed in the lens blank 2 and that formed on the lap blank 4. The holder has a raised central portion which is adaptable to be received within the chuck of a surfacing machine responsible for cutting an inverse image of the surface of the lens to be formed. The lap blank assembly is thereafter dismounted from the surfacing machine chuck 10 and in turn secured for oscillating motion to a finishing machine whereupon an abrasive pad is applied to the cut lap blank surface for finishing of a correspondingly shaped lens surface.

By the foregoing, an improved lap blank and associated holder has been described by way of the preferred embodiment of the invention. However, numerous modifications and substitutions may be had without the parting from the spirit of the invention. For example, the engagement member 16 having the corresponding shape of the recess formed in the lap blank 4 may constitute a permanent part of the chuck 3 or the lower clamp arm 58 of the finishing machine shown in FIG. 6. In addition where it is not contemplated to remove the lap blank once it is initially mounted to the holder 6, it is in the purview of the present invention to use spike-like members which extend outwardly from the first side face 8 of the holder and pierce the compressible material forming the lap 4. Accordingly, the present invention has been described by way of illustration rather than limitation.

I claim:

1. A lap blank assembly comprising:

a disposable lap having a first side face and an opposite second side face separated from one another by a given thickness;

a reusable holder having one face facing one of said first and second side faces of said lap, engagement means extending outwardly from said holder face a given distance therefrom for engaging said lap inwardly and beyond the one of said first and second lap faces facing said holder to secure the lap against relative rotational movement and to cause the lap to be releasably gripped by the holder;

wherein said lap is formed from a material capable of causing the holder engagement means to be releasably gripped when it is inserted within said lap beyond the involved one of said first and second lap faces;

said engagement means is carried by each of said lap blank and said holder such that said engagement means also includes at least one recess extending inwardly a predetermined depth into said lap from one of said first and second lap faces into which said engagement means extending outwardly from said holder is inserted;

said engagement means carried by said holder has at least one projection with a first given width and said at least one recess formed in said lap blank has a second given width which is slightly smaller in dimension than that of said first given width such that said at least one projection is insertable into said at least one recess and the material comprising said lap yields creating an interference therebetween;

said engagement means disposed on said holder includes a cross-shaped projection extending along a major and minor axis and wherein said at least one recess formed in said lap is correspondingly sized and shaped along a major and a minor axis to receive said cross-shaped projection;

said major and minor axes on each of said lap and said holder intersect at the geometric centers of each of said lap and said holder, said holder including another side face disposed oppositely relative to said one side face and said holder one face includes said engagement means and said holder another face presenting a substantially flat surface defined by a central raised portion, said holder central raised portion has two opposite flats defining each opposite side thereof; and wherein each of said flats is connected by adjacent side margins having a tapered surface tapering inwardly into said central raised portion from said holder another face towards said holder one face.

2. A lap blank assembly as defined in claim 1 further characterized in that said side margins being oriented in a parallel relationship to one of said major and minor axes of said engagement means formed in said blank and on said holder such that said holder may be inserted in a correct orientation into said lap.

3. A lap blank assembly as defined in claim 2 further characterized in that said raised central portion has diametrically opposite ends, and at diametrically opposite ends of said raised central portion of said holder are indicators for indicating the presence of said lap in a surfacing machine.

4. A lap blank assembly as defined in claim 2 further characterized by said holder another face including means for engaging said holder on a finishing machine.

5. A lap blank assembly as defined in claim 2 further characterized in that said recess formed in said lap blank is cross-shaped and extends inwardly into said blank from said lap second surface a given depth therefrom;

said engagement means extending outwardly from said holder one face a second given depth; and wherein said first given depth being equal to or slightly greater than said second given depth.

6. A lap blank assembly as defined in claim 5 further characterized in that said lap is formed from a polystyrene foam and said holder is formed from a glass filled polymer.

7. A reusable lap blank holder for releasably mounting a disposable lap to a machine, said lap blank holder comprising:

a body portion generally defined by a raised central portion having two oppositely facing locating surfaces spaced from one another by adjacently disposed interconnecting surfaces, said holder having a first face and an opposite second face with said first face including engagement means projecting outwardly therefrom;

said engagement means projecting outwardly from said holder first face a given distance sufficient to engage within a lap blank for the purpose of holding it against relative rotational movement;

said engagement means extending outwardly from one of said holder first and second faces and being oriented relative to said oppositely facing locating surfaces so as to be disposed at a known orientation when the holder is mounted in a machine means formed as part of said raised central portion for allowing said holder to be gripped by a user in such a way that the orientation of said engagement means is known; and disposed between said interconnecting surfaces and said flat surfaces of said raised central portion are two indicators embedded within said holder for indicating the presence of said holder on a machine.

8. A holder as defined in claim 7 further characterized by means formed as part of said raised central portion for allowing said holder to be gripped by a user in such a way that the orientation of said engagement means is known; and wherein said means formed as part of said raised central portion allowing gripping and orienting of said holder includes said interconnecting surfaces being disposed diametrically oppositely from one another and tapering inwardly from said holder second face towards said holder first face.

9. A holder as defined in claim 7 further characterized in that said holder is formed from a composite of nylon and a percentage of glass filler.

* * * * *